US012528002B2

(12) United States Patent
Woods

(10) Patent No.: US 12,528,002 B2
(45) Date of Patent: Jan. 20, 2026

(54) GOLF SWING TRAINING DEVICE AND METHOD OF USING THE SAME

(71) Applicant: David Woods, Indian Wells, CA (US)

(72) Inventor: David Woods, Indian Wells, CA (US)

( * ) Notice: Subject to any disclaimer, the term of this patent is extended or adjusted under 35 U.S.C. 154(b) by 0 days.

(21) Appl. No.: 18/634,804

(22) Filed: Apr. 12, 2024

(65) Prior Publication Data

US 2024/0252898 A1 Aug. 1, 2024

Related U.S. Application Data

(63) Continuation-in-part of application No. 17/658,441, filed on Apr. 7, 2022, now abandoned, which is a continuation-in-part of application No. 17/647,714, filed on Jan. 11, 2022, now Pat. No. 12,121,789.

(51) Int. Cl.
*A63B 69/00* (2006.01)

(52) U.S. Cl.
CPC ..... *A63B 69/0059* (2013.01)

(58) Field of Classification Search
CPC ..... A63B 69/0059
USPC ..... 473/205, 213, 214, 276, 458
See application file for complete search history.

(56) References Cited

U.S. PATENT DOCUMENTS 3,235,258 A * 2/1966 Stroburg ..... A63D 5/00 473/213
3,400,934 A * 9/1968 Muehl ..... A63B 71/146 473/213
3,423,095 A 1/1969 Cox
3,606,342 A 9/1971 Albertson, Jr.
3,700,245 A * 10/1972 Nannini ..... A63B 69/0059 473/213
4,241,922 A * 12/1980 Elliott, Jr. ..... A63B 69/0059 473/213
5,033,743 A * 7/1991 Wright ..... A63B 43/00 273/DIG. 20
5,280,906 A * 1/1994 Vitale ..... A63B 43/00 273/DIG. 20
5,447,312 A 9/1995 Nixon et al.
5,499,820 A 3/1996 Albertsson
5,634,854 A 6/1997 Albertsson
5,876,292 A * 3/1999 Hamilton ..... A63B 69/3608 273/DIG. 30

(Continued)

FOREIGN PATENT DOCUMENTS

GB 2166959 A 5/1986

*Primary Examiner* — Nini F Legesse
(74) *Attorney, Agent, or Firm* — FisherBroyles, LLP; Rob L. Phillips

(57) ABSTRACT

A golf swing training device attachable to a golfer's wrist. A rigid hand stop prevents the golfer's hand from bending beyond a pre-established distance or angle during a golf backswing. The rigid hand stop is configured and positioned to not interfere with, or restrict, the golfer's address of the golf ball or the early part of the backswing. The rigid hand stop allows desired movement of, and prevents undesired movement of, the golfer's rear hand (i.e., right hand for right-handed golfers and left hand for left-handed golfers) as the golfer moves from ball address through the backswing to the downswing to the impact position and finally the follow through. A pliable ball member may be integral with, or removably attachable to, the golf swing training device to maintain wrists of the user in a spaced relationship through a golf swing.

5 Claims, 19 Drawing Sheets

(56) References Cited

U.S. PATENT DOCUMENTS

| | | | | |
|---|---|---|---|---|
| 5,984,813 | A * | 11/1999 | Cinnella | A63B 37/14 473/613 |
| 7,635,308 | B2 * | 12/2009 | Merrill | A63B 69/3608 473/409 |
| 7,758,437 | B1 * | 7/2010 | Stewart | A63B 69/3608 473/409 |
| 7,976,398 | B2 * | 7/2011 | Clawson | A63B 69/0059 473/227 |
| 8,708,843 | B1 * | 4/2014 | Sekac | A63B 43/002 473/422 |
| 2006/0172812 | A1 | 8/2006 | Kraus | |
| 2011/0111876 | A1 | 5/2011 | Hart | |
| 2015/0224382 | A1 * | 8/2015 | Hall | A63B 69/38 473/450 |
| 2021/0379461 | A1 * | 12/2021 | Mulloy | A63B 69/0059 |

* cited by examiner

GOLF SWING TRAINING DEVICE AND METHOD OF USING THE SAME

CROSS-REFERENCE

This application is a continuation-in-part of, and claims priority to U.S. patent application Ser. No. 17/658,441 filed Apr. 7, 2022, which claims priority to continuation-in-part U.S. patent application Ser. No. 17/647,714 filed Jan. 11, 2022, both of which are incorporated by reference herein for all purposes.

FIELD OF THE INVENTION

The embodiments of the present invention relate to a device for teaching hand position through a golf swing.

BACKGROUND

Golf is an extremely popular sport played by millions of people around the world. Despite its popularity, golf is an extremely frustrating game. The most difficult aspect of golf is mastering the swing. However, mastering the golf swing is easier said than done. A good golf swing requires many facets, including proper hand position.

It would be advantageous to develop a simple, inexpensive device and method of using the same for teaching golfer's the proper hand position throughout a golf swing.

SUMMARY

One well-known problem encountered by golfers is breaking of their hands or wrists during the backswing. When this occurs, the entire golf swing may be thrown off resulting in poor quality golf shots.

One embodiment of the present invention is directed to a device comprising: a wrist portion for attaching the device to the golfer's wrist and providing stability and a hand portion for preventing an overly bent hand. The hand portion of the device is configured to allow desired movement of, and prevent undesired movement of, the golfer's rear hand (i.e., right hand for right-handed golfers and left hand for left-handed golfers) as the golfer moves from ball address through the backswing to the downswing to the impact position and finally the follow through.

In an alternative embodiment, the device includes a triangular wedge member configured to maintain a user's wrists in a spaced relationship through the golf swing. The triangular wedge member aids in wrist connection and torque throughout the golf swing improving overall golf swing symmetry and golf club plane consistency. In practice, the pressure applied by opposite wrists toward one other create muscle memory related to wrist connectivity. As detailed below, the wedge member may take on other shapes and accomplish the same objective.

As designed, the rigid hand portion of the device assists golfers with maintaining proper hand position throughout a golf swing. The rigid hand portion is designed such that the rear hand may flex rearward when desired (e.g., at address and elsewhere during the golf swing) but prevent overly flexing during various golf swing points.

Other variations, embodiments and features of the present invention will become evident from the following detailed description, drawings and claims.

DETAILED DESCRIPTION

Figure 1:
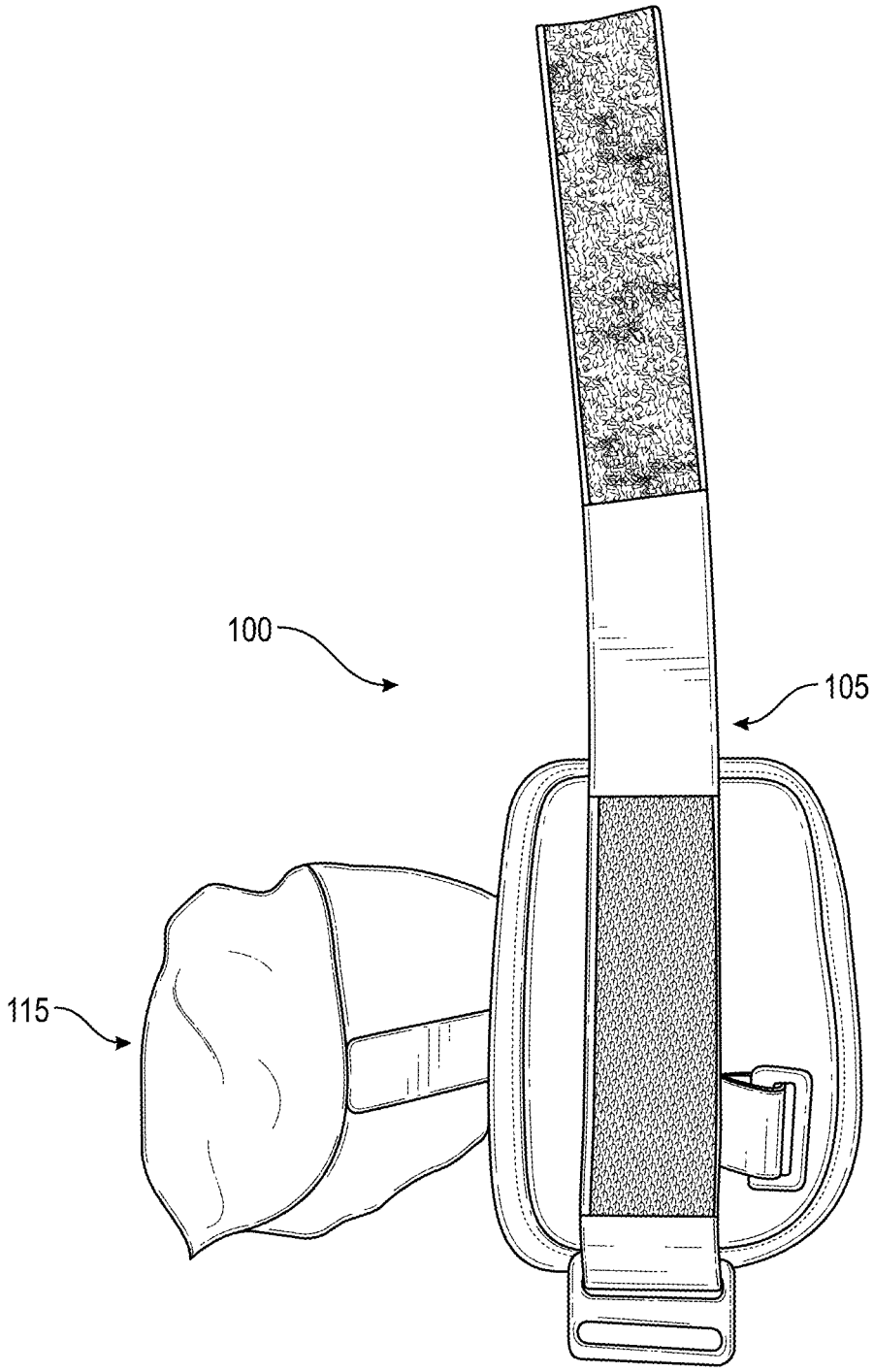
FIG. 1 illustrates a top-down rear view of a golf swing training device in an open position according to the embodiments of the present invention.
Figure 2:
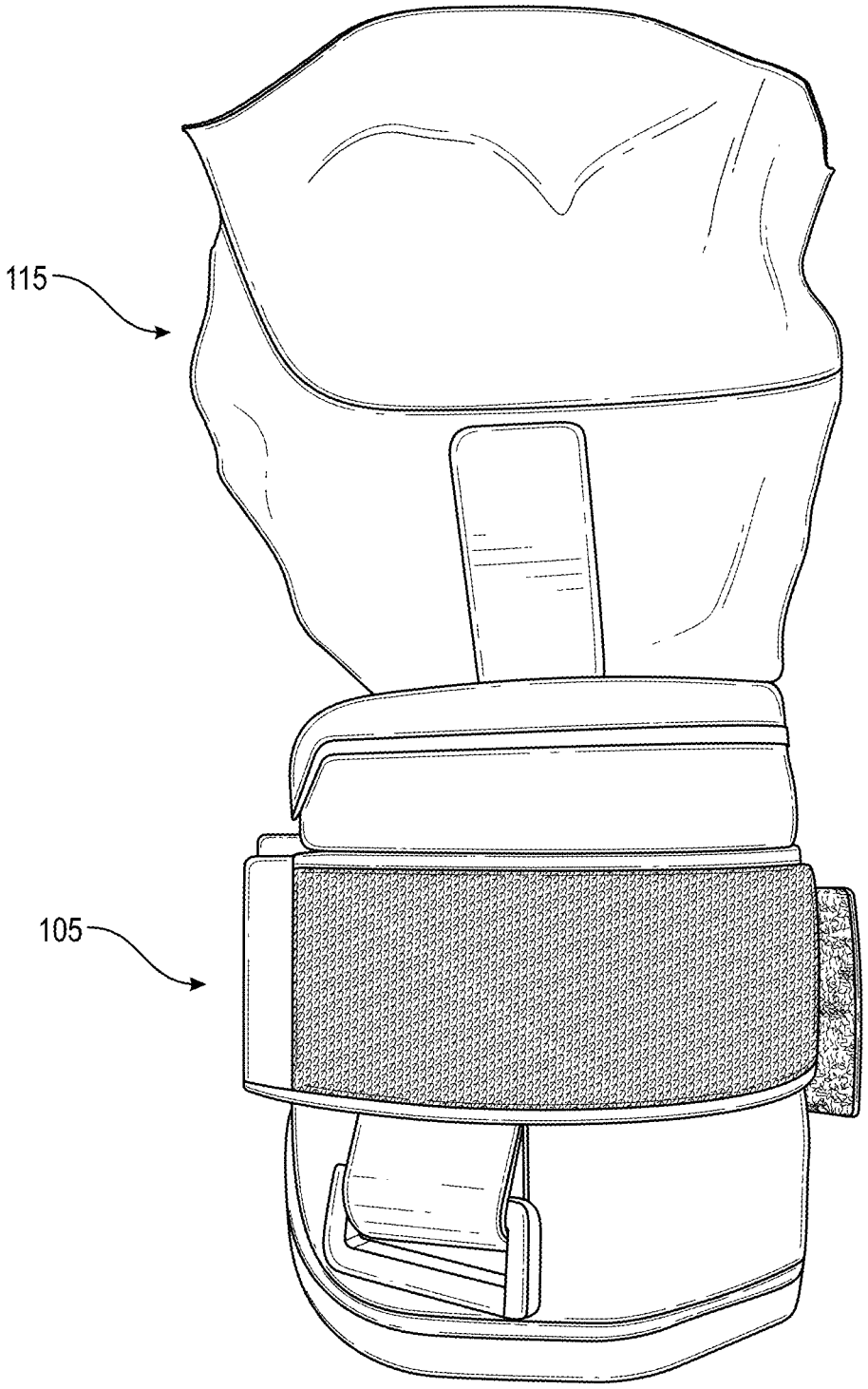
FIG. 2 illustrates a top-down rear view of the golf swing training device in a closed position according to the embodiments of the present invention.
Figure 3:
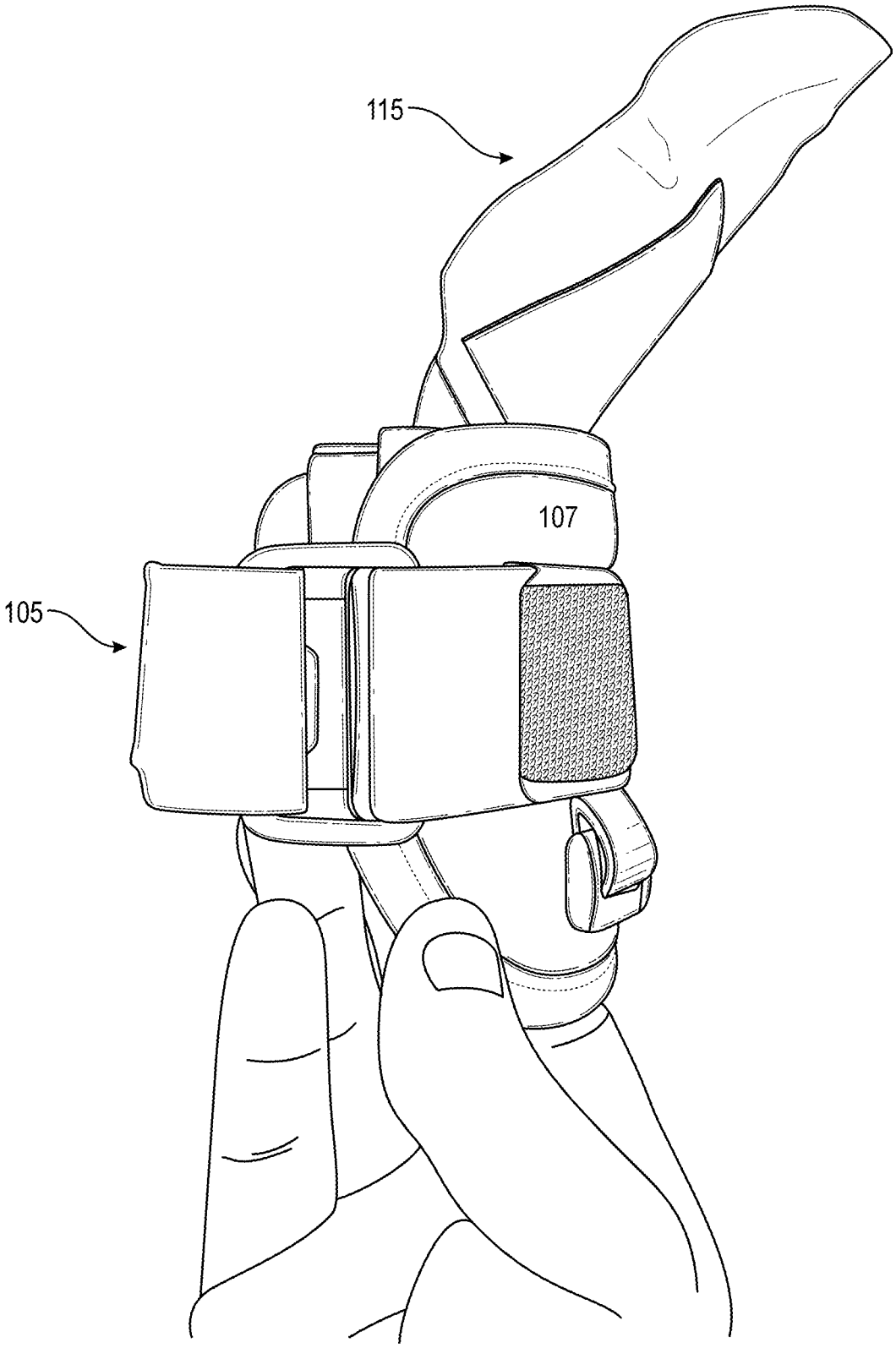
FIG. 3 illustrates a side view of the golf swing training device in a closed position according to the embodiments of the present invention.
Figure 4:
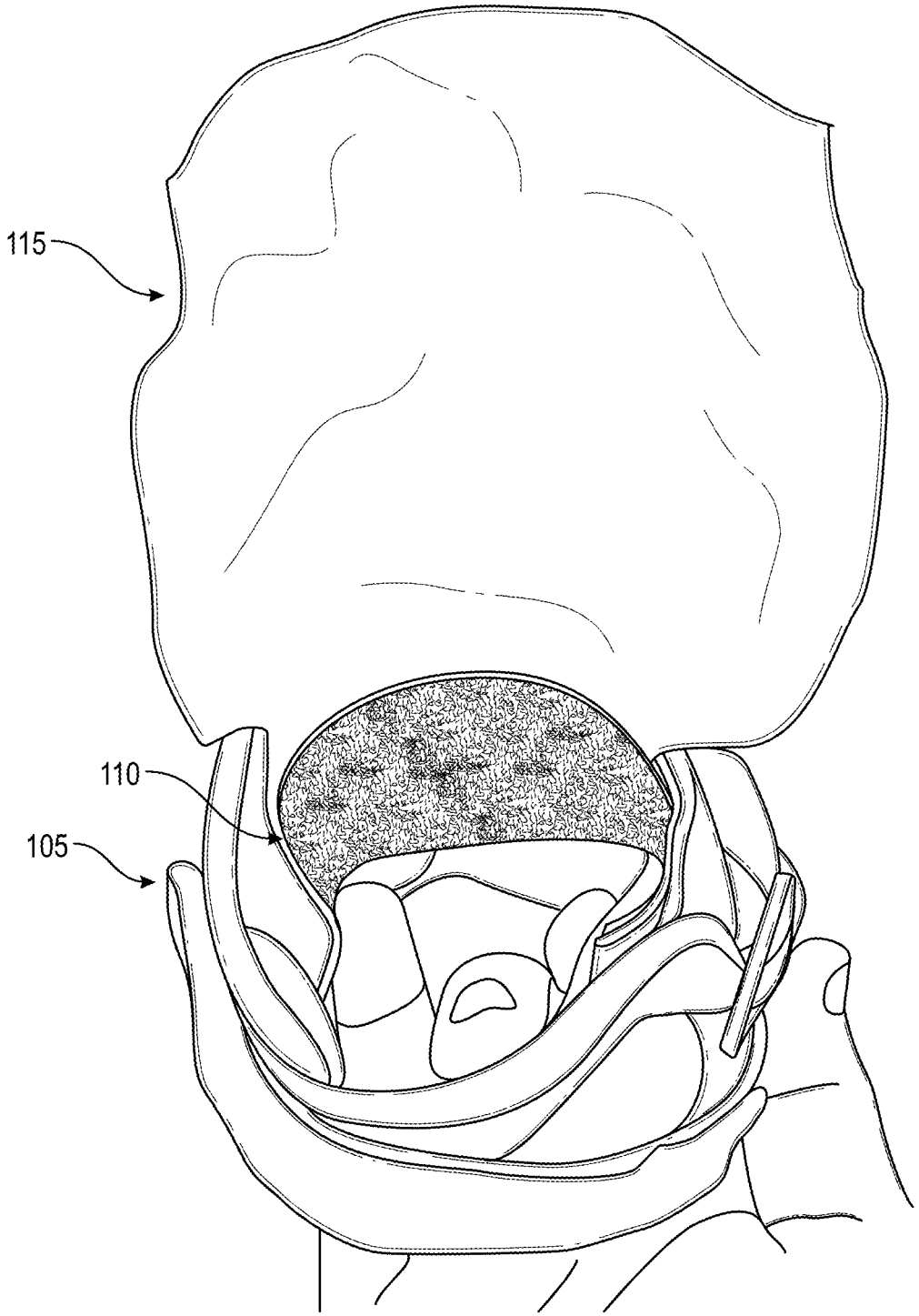
FIG. 4 illustrates a front view of the golf swing training device in a closed position according to the embodiments of the present invention.
Figure 5:
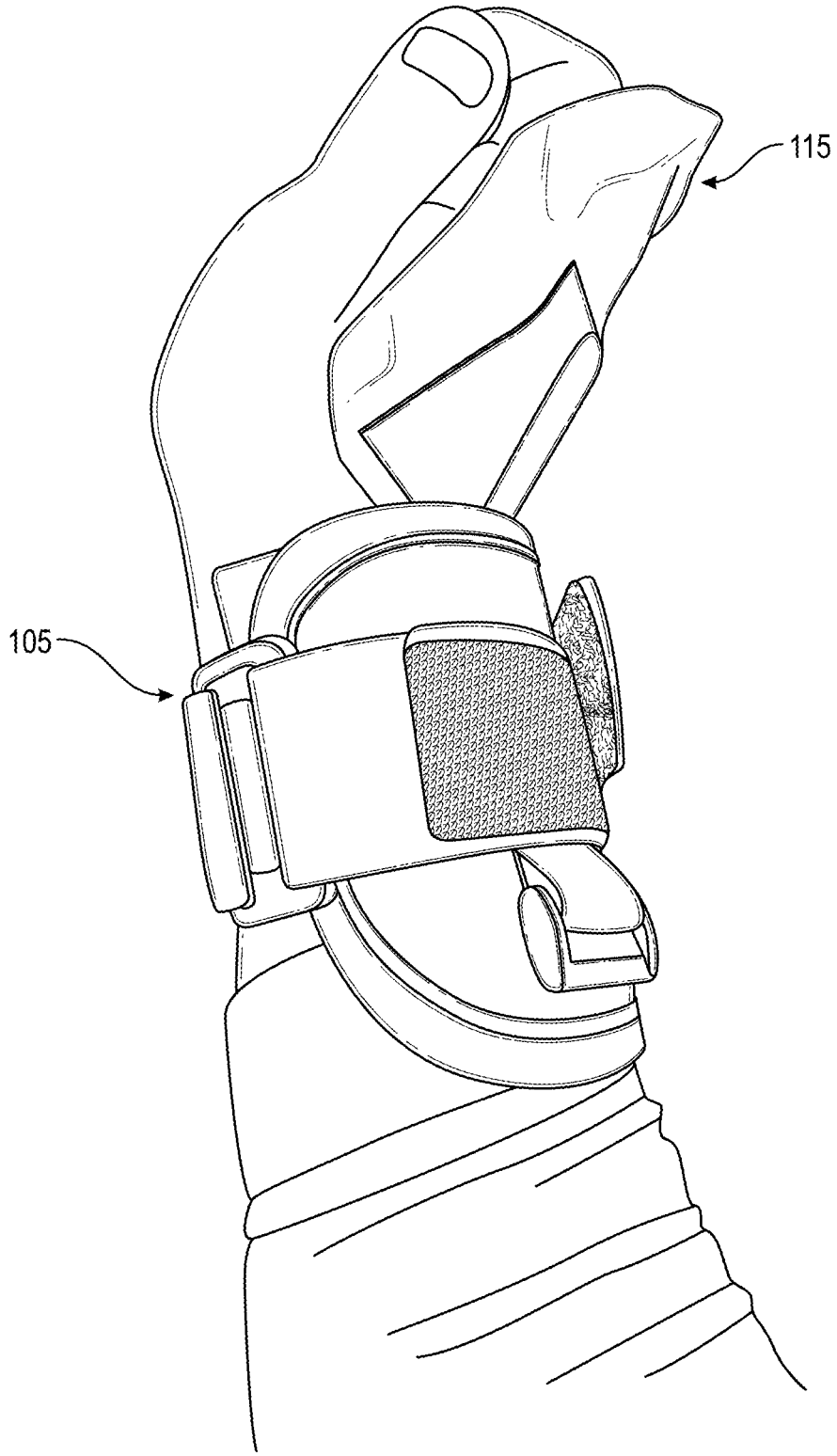
FIG. 5 illustrates the golf swing training device being worn and a golfer's wrist able to flex rearward according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the components of the golf swing training device according to the embodiments of the present invention may be fabricated of any suitable materials. For example, the hand and wrist portion may be fabricated of plastics, alloys, metals, composites, rubber, etc.

In broadest form, the embodiments of the present invention comprise a device having a wrist portion for attaching the device to the golfer's wrist and providing stability and a hand portion for preventing an overly flexed hand/wrist during the backswing.

FIGS. 1-5 show various views of the golf swing training device 100 according to the embodiments of the present invention. As shown, the device 100 includes an adjustable strap 105, wrist support 110 and rigid hand stop 115. In one embodiment, the wrist support 110 is a rigid semi-circular member configured to retain a golfer's wrist. As shown, the wrist support 110 is integral with the rigid hand stop 115. Alternatively, the wrist support 110 may be integral with the adjustable strap 105.

The adjustable strap 105 is configured to affix the golf swing training device 100 to the wrist of the golfer's rear hand around the wrist support 110. In one embodiment, the strap incorporates a longitudinal portion 107 to provide additional support to the wrist. In one embodiment, when affixed to the wrist, the adjustable strap 105 tightens about the wrist support 110 thereby keeping the wrist secured as well as the golf swing training device 100 secure thereon.

Figure 6A:
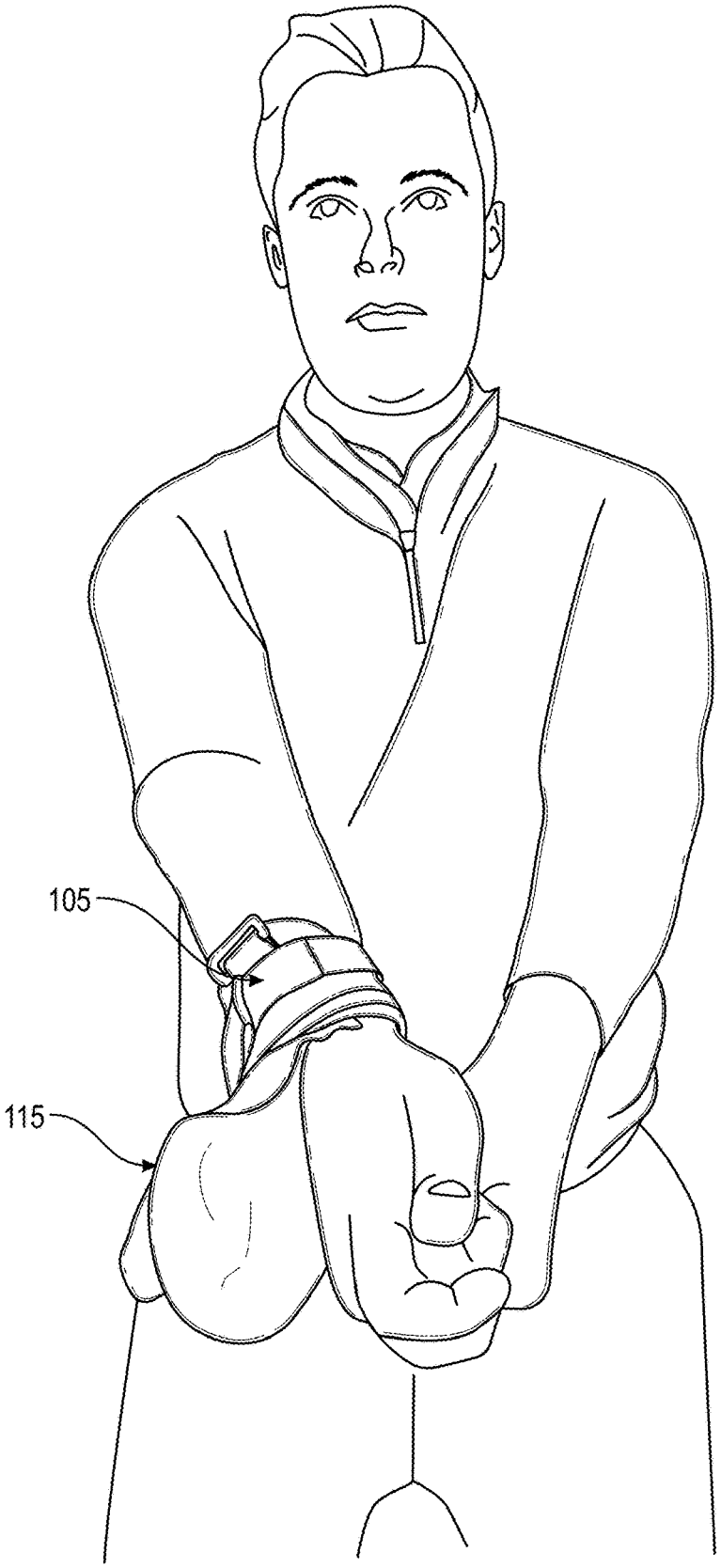
FIGS. 6A-6C illustrate the golf swing training device being worn as a golfer progresses through a backswing according to the embodiments of the present invention.

The rigid hand stop 115 extends from the wrist support 110 forward towards the back of the rear hand of the golfer when worn. As best shown in FIG. 6A, the rigid hand stop 115 extends, at an angle A relative to the forearm of the golfer forming a space between the back of the hand and the rigid hand stop 115. In other words, the rigid hand stop 115 extends away from the golfer's hand when it is an extension of the plane of the forearm. In one embodiment, the rigid hand stop is positioned commensurate with a professional golfer's hand position.

Figure 6B:
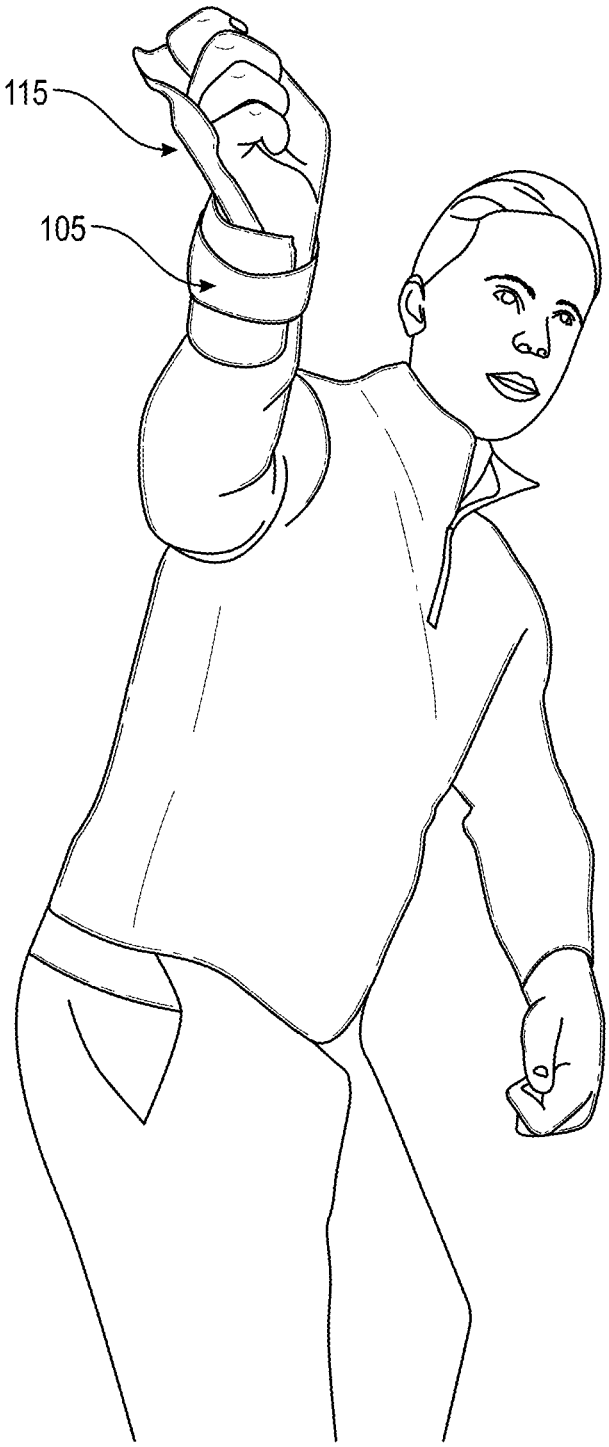
Figure 6C:
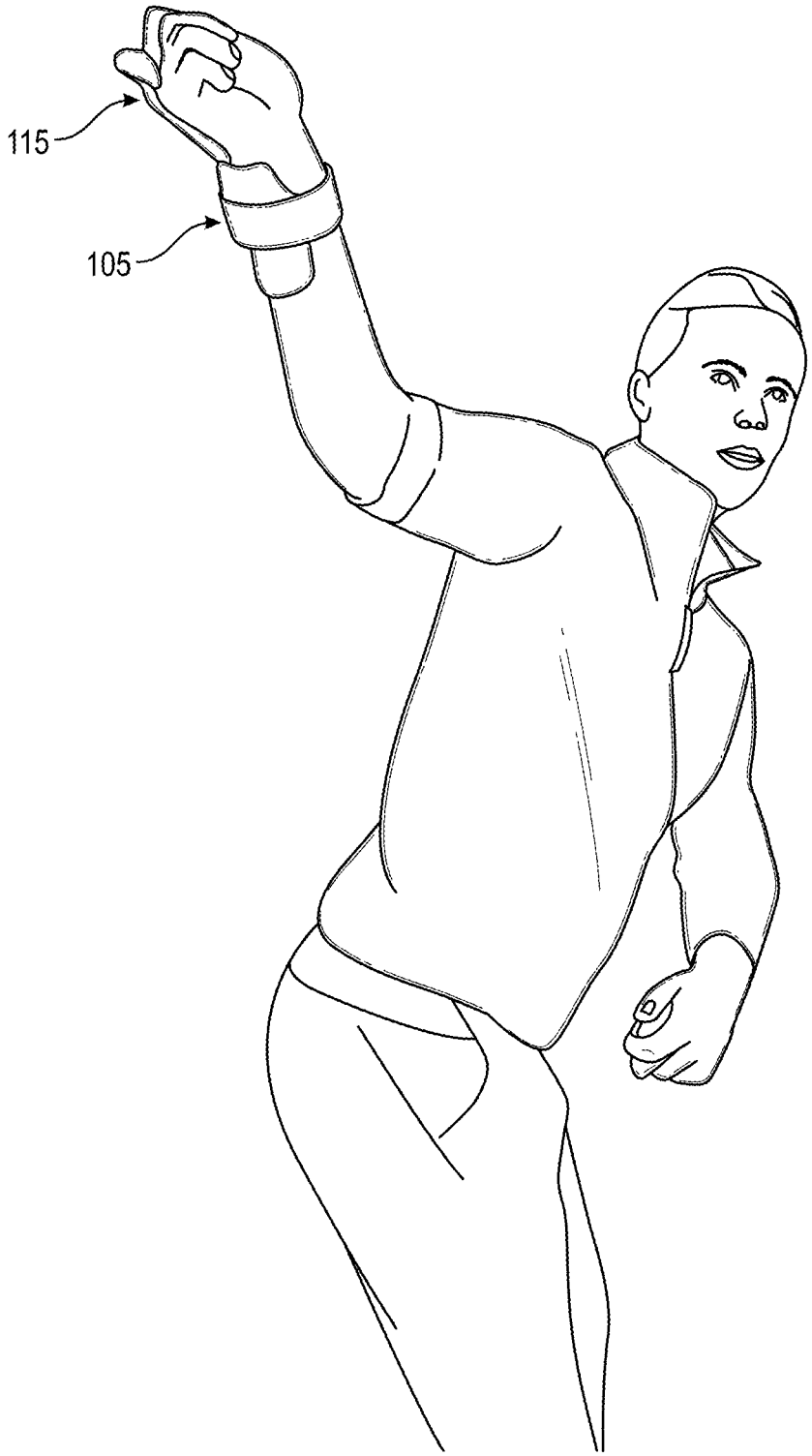

As shown in FIG. 6A, when the golfer addresses the ball, the space is empty. In this manner, the golfer can address the ball in a normal fashion. As shown in FIGS. 6B and 6C, as the golfer moves through the backswing, the space permits the rear hand to bend about the wrist towards the rigid hand stop 115. The rigid hand stop 115 is configured to prevent the rear hand from bending too far and negatively affecting the golfer's swing.

Figure 7:
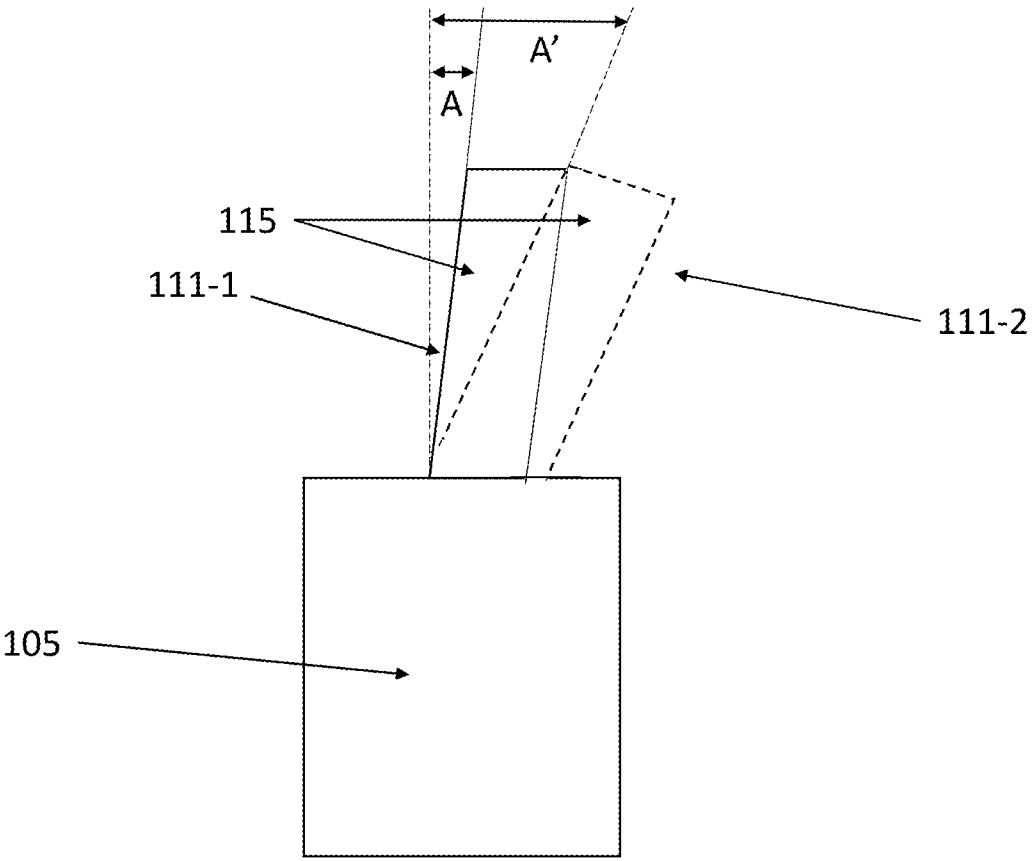
FIG. 7 illustrates the golf swing training device with an adjustable rigid hand stop according to the embodiments of the present invention.

In one embodiment, the rigid hand stop 115 is designed to accommodate the golfer's hand by taking on a concave shape. In another embodiment, the rigid hand stop 115 may incorporate finger channels or grooves to accommodate and receive at least upper portions of each finger of the golfer. In another embodiment, as shown in FIG. 7, the rigid hand stop 115 may be positionally adjusted to change angle A to accommodate different golf swings of different golfers. As shown, the rigid hand stop 115 can be moved from a first position 111-1 to a second position thereby changing angle A to larger angle A' (or a smaller angle A (not shown)). A spring-biased hinge and lock combination or other mechanism may facilitate the adjustment of the rigid hand stop 115.

Figure 8A:
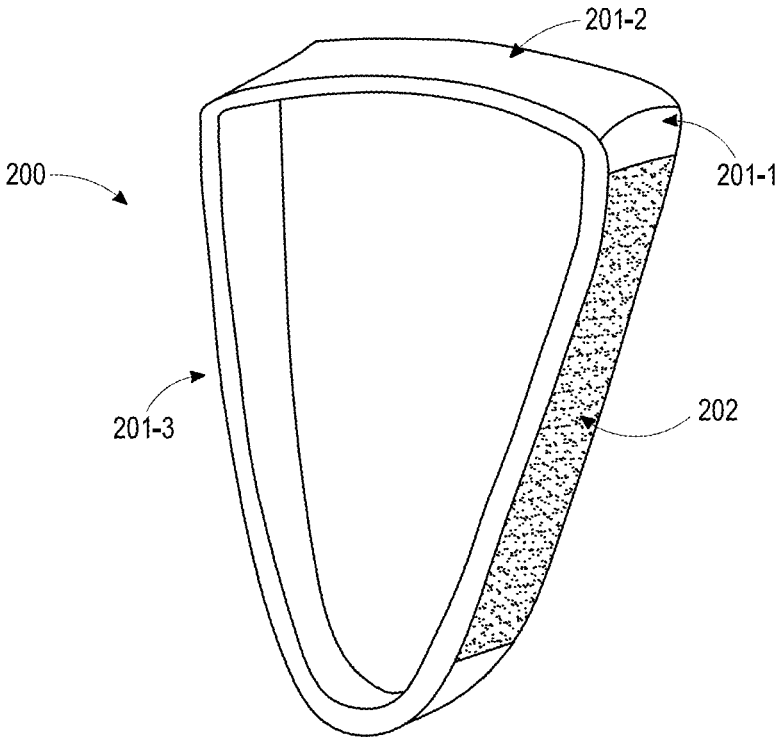
FIGS. 8A-8B illustrate perspective and front views of a triangular wedge member used with an alternative embodiment of the golf swing training device according to the embodiments of the present invention.
Figure 8B:
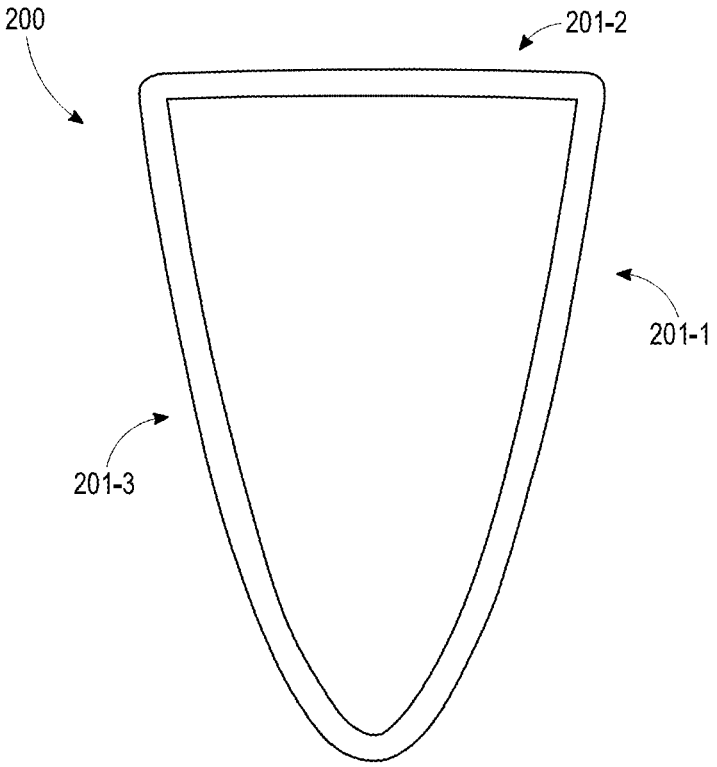

FIGS. 8A-8B shows a wedge member 200 used with an alternative embodiment of the golf swing training device 100' according to the embodiments of the present invention. In one embodiment, the wedge member 200 is integral with wrist support 110' of the golf swing training device 100'. Alternatively, the wedge member 200 is a separate member removably attachable to the wrist support 110' of the golf swing training device 100'.

Figure 9A:
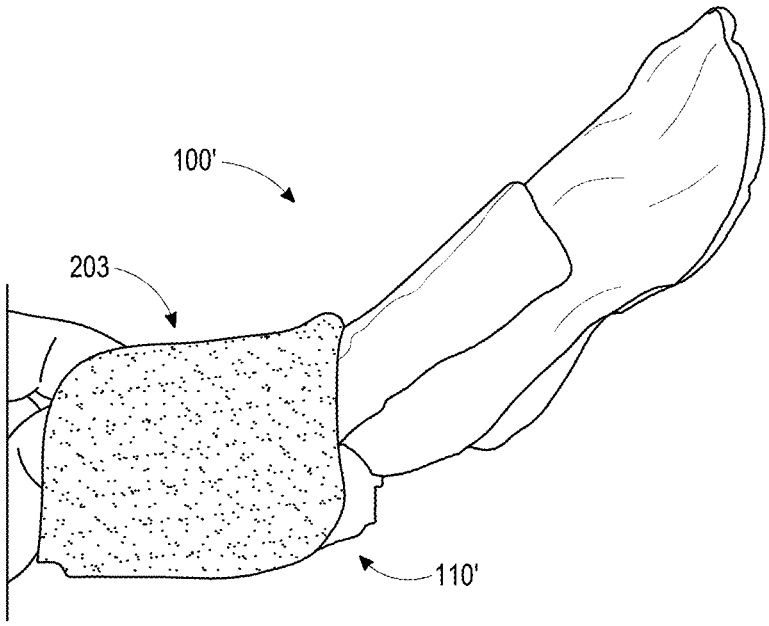
FIGS. 9A and 9B show side and top down views of a golf swig training device with attachments means for the triangular wedge member according to the embodiments of the present invention.
Figure 9B:
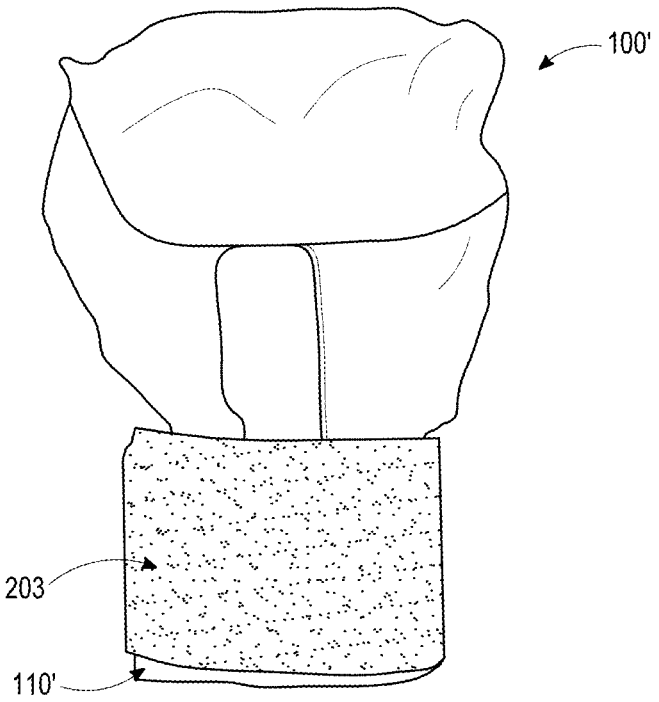
Figure 10A:
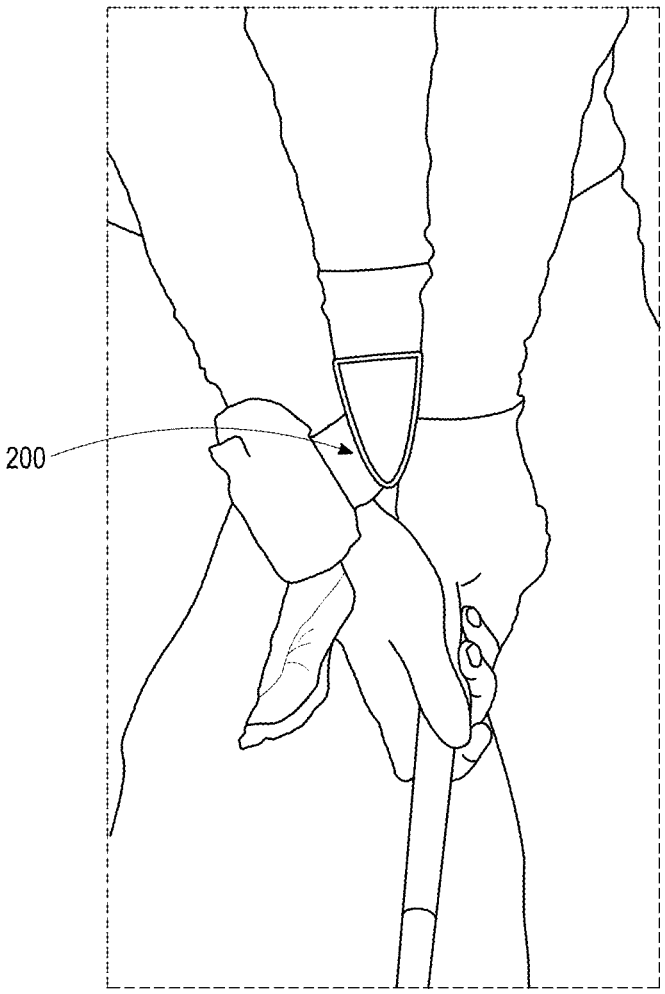
FIGS. 10A-10B illustrate the alternative embodiment incorporating the triangular wedge member in practice according to the embodiments of the present invention.
Figure 10B:
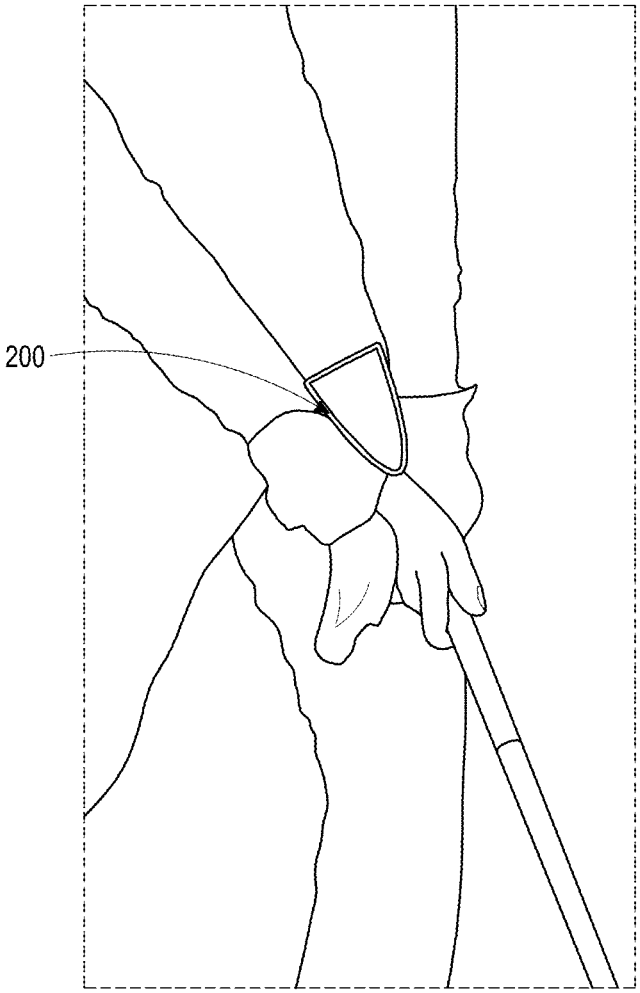

As shown, the wedge member 200 takes on a triangular shape with three sides 201-1, 201-2 and 201-3. In the embodiment removably attachable to the wrist support 110' of the golf swing training device 100', at least one side 201-1 includes means for attachment to the wrist support 110' of the golf swing training device 100'. For example, in one embodiment, one side 201-1 of the triangular wedge member 200 includes a section of hook and loop fasteners 202 compatible and attachable to a section of hook and loop fasteners 203 positioned on the wrist support 110' of the golf swing training device 100' as best shown in FIGS. 9A and 9B. In this manner, the user may adjust the position of the wedge member 200. Other attachment means, including snaps, straps, locks, etc., may be used to removably attach the wedge member 200 to the wrist support 110' of the golf swing training device 100'.

When integral with the wrist support 110' of the golf swing training device 100', the wedge member 200 may be permanently attached but able to slide or otherwise move and lock into various positions for purposes of positional adjustment.

In another embodiment, the portions (e.g., sides/edges) of the wedge member 200 may be widened and/or formed with concave surfaces to more securely grasp a user's wrists. For example, with the wedge member 200 shown in FIGS. 8A and 8B, sides 201-1, 201-2 may be concave and wider to receive a user's wrist rather than simply block the wrists with a flat, thinner surface.

While the wedge member 200 is shown as a triangular member, those skilled in the art will recognize that the wedge member 200 may take on other shapes such as oval, rhombus, trapezoid, etc., as long as the wedge member 200 aids in wrist connection and torque throughout the golf swing improving overall golf swing symmetry and golf club plane consistency by utilizing pressure applied by opposite wrists toward one other to create muscle memory related to wrist connectivity.

Figure 11A:
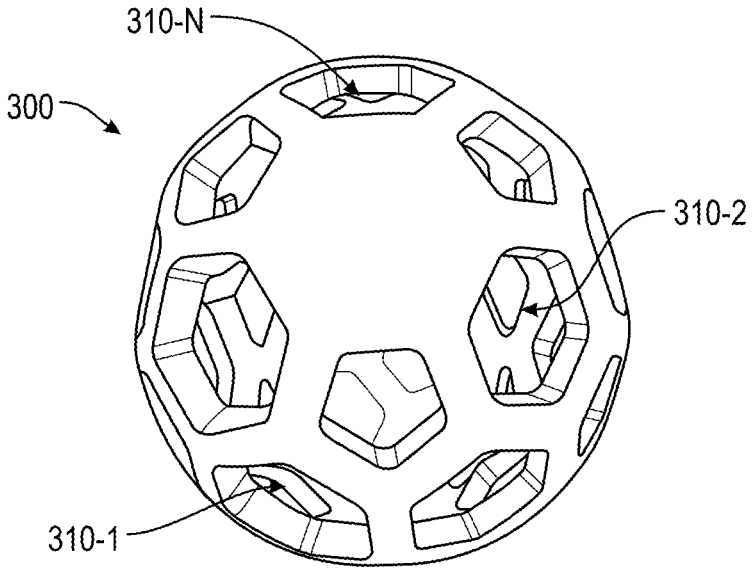
FIGS. 11A-11B illustrate various views of a pliable ball member used with an alternative embodiment of the golf swing training device according to the embodiments of the present invention.
Figure 11B:
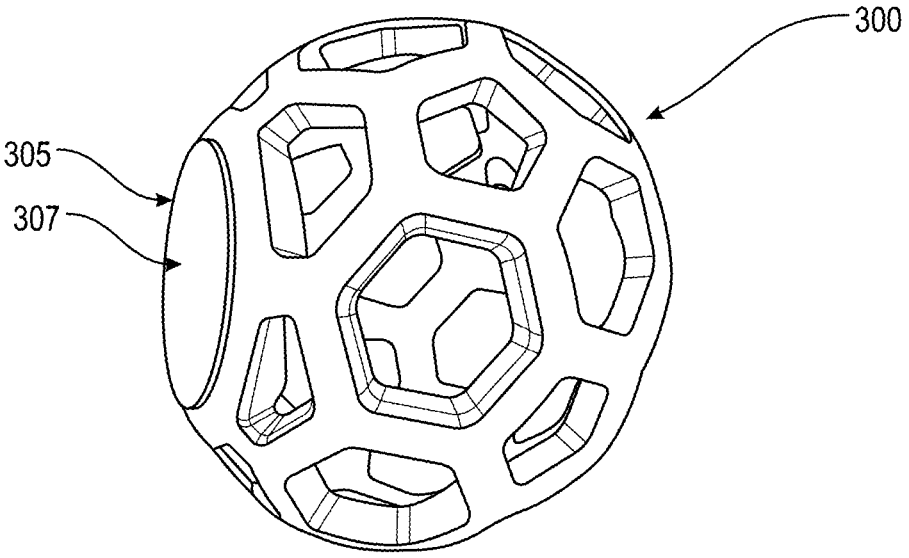
Figure 12:
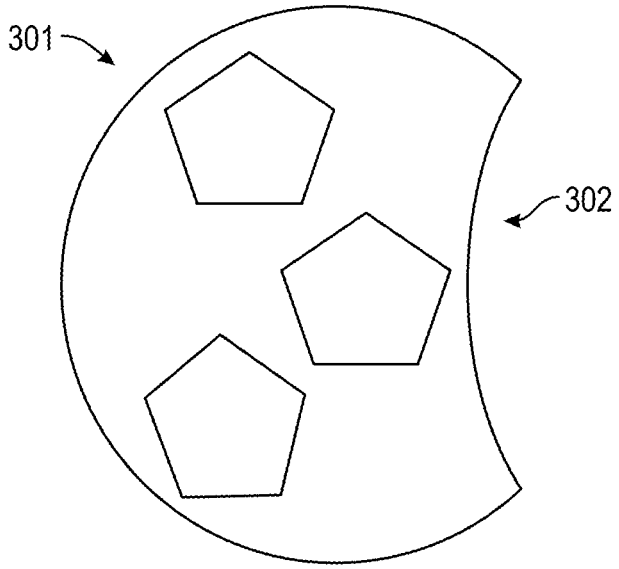
FIG. 12 illustrates an alternative ball member design according to the embodiments of the present invention.

FIGS. 11A-11B illustrate various views of a pliable ball member 300 used with an alternative embodiment of the golf swing training device according to the embodiments of the present invention. As shown, in one embodiment, the pliable ball member 300 is not completely spherical having one flat area 305. The flat area 305 includes attachments means, such as hook and loop fasteners 307, for attachment to a wrist member like devices 100, 100' or 315 (i.e., a wrist wrap). Other attachment means, like snaps, magnets, clips, etc. may serve to attach the ball member 300 to the wrist device 100, 100' or 315. The ball member 300 may have multiple flat areas. Alternatively, as shown in FIG. 12, a ball member 301 may have one or more concave portions 302.

Figure 13:
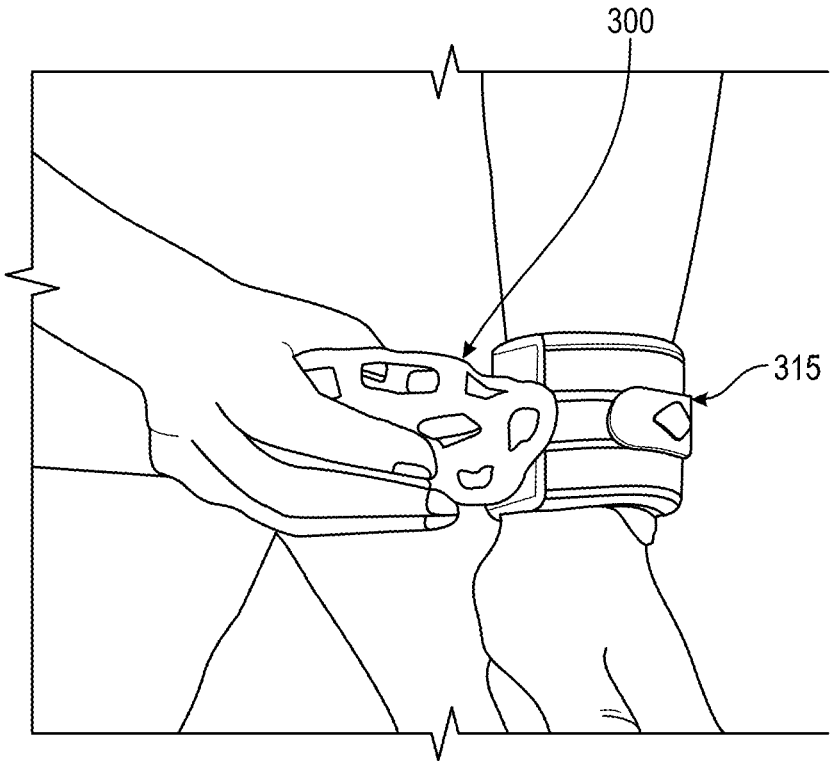
FIG. 13 illustrates the pliable ball member being compressed and attached to a wrist unit according to the embodiments of the present invention.
Figure 14:
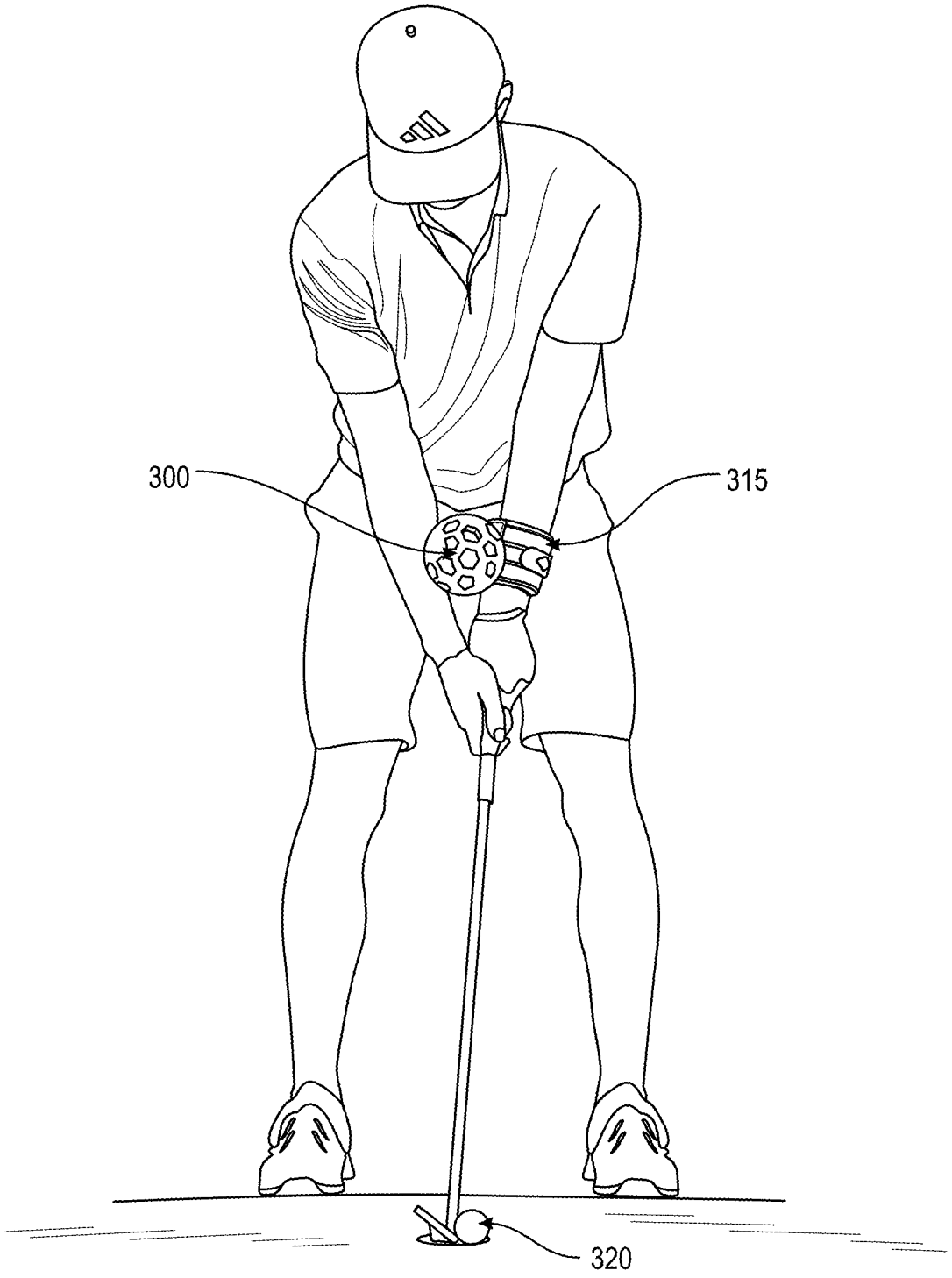
FIG. 14 illustrates the pliable ball member being attached to a wrist unit while a golfer addresses a teed golf ball according to the embodiments of the present invention.

As best seen in FIG. 13, a plurality of polygonal openings 310-1 through 310-N allow the ball member 300 to compress responsive to external forces being applied. The openings 310-1 through 310-N may take on any shapes and dimensions. FIG. 14 shows the ball member 30 in position, attached to the wrist member 315, while a golfer addresses the teed golf ball 320. The ball member 300 aids in wrist connection and torque throughout the golf swing improving overall golf swing symmetry and golf club plane consistency by utilizing pressure applied by opposite wrists toward one other to create muscle memory related to wrist connectivity.

While the ball member 300 is shown being attachable to the wrist device 100, 100' or 315, alternatively, the ball member 300 may be integral with the wrist device whereby they are a single unit.

Although the invention has been described in detail with reference to several embodiments, additional variations and modifications exist within the scope and spirit of the invention as described and defined in the following claims.

I claim:

1. A golf swing training device comprising:

a strap configured for attachment to a wrist of a user;

a wrist support in communication with said strap;

a rigid hand stop joined to said strap and/or wrist support;

wherein said rigid hand stop is angled to define a space between the rigid hand stop and a hand of a user when worn; and a pliable ball member removably attachable to said wrist support for maintaining wrists of a user in a spaced relationship through a golf swing when attached to said wrist support.

2. The golf swing training device of claim 1 wherein said ball member has a flat portion.

3. The golf swing training device of claim 1 wherein said ball member includes one or more concave portions.

4. The golf swing training device of claim 1 wherein said ball member includes a plurality of openings.

5. The golf swing training device of claim 1 wherein said pliable ball member is attachable to said wrist support using hook and loop fasteners, snaps, magnets and clips.

* * * * *